US007743821B2

(12) United States Patent
Bunker et al.

(10) Patent No.: US 7,743,821 B2
(45) Date of Patent: Jun. 29, 2010

(54) AIR COOLED HEAT EXCHANGER WITH ENHANCED HEAT TRANSFER COEFFICIENT FINS

(75) Inventors: Ronald Scott Bunker, Niskayuna, NY (US); Bin Wei, Mechanicville, NY (US); Wayne C. Hasz, Pownal, VT (US); Nania Massimiliano, Vibo Valentia (IT)

(73) Assignee: General Electric Company, Schenectady, NY (US)

( * ) Notice: Subject to any disclaimer, the term of this patent is extended or adjusted under 35 U.S.C. 154(b) by 99 days.

(21) Appl. No.: 11/493,022

(22) Filed: Jul. 26, 2006

(65) Prior Publication Data

US 2008/0023180 A1 Jan. 31, 2008

(51) Int. Cl.
*F28F 1/20* (2006.01)
*F28D 7/10* (2006.01)

(52) U.S. Cl. ..... 165/181; 165/109.1

(58) Field of Classification Search ..... 165/80.3, 165/109.1, 151, 152, 104.34, 181, 182, 184; 361/695, 697

See application file for complete search history.

(56) References Cited

U.S. PATENT DOCUMENTS 1,734,136 A * 11/1929 Kramer ..... 165/184
1,832,769 A * 11/1931 Graham ..... 165/160
2,070,539 A * 2/1937 Muhleisen ..... 165/182
2,667,337 A * 1/1954 Chapman ..... 165/184
2,938,333 A 5/1960 Wetzler
3,384,165 A * 5/1968 Mathews ..... 165/122
4,154,293 A 5/1979 Fenner et al.
4,538,677 A * 9/1985 Bodas et al. ..... 165/146
4,689,242 A 8/1987 Pike
4,984,626 A * 1/1991 Esformes et al. ..... 165/151
5,377,746 A 1/1995 Reid et al.
5,567,986 A * 10/1996 Ishida ..... 257/707
5,577,555 A 11/1996 Hisajima et al.
5,628,362 A 5/1997 Rew et al.
6,098,397 A 8/2000 Glezer et al.
6,137,076 A 10/2000 Esslinger et al.
6,254,997 B1 7/2001 Rettig et al.
6,349,761 B1 * 2/2002 Liu et al. ..... 165/151

(Continued)

FOREIGN PATENT DOCUMENTS

JP 02211657 A * 8/1990

OTHER PUBLICATIONS

Bunker et al., entitled, "Heat Exchanger Tube With Enhanced Heat Transfer Co-Efficient and Related Method" U.S. Appl. No. 11/541,682, filed Oct. 3, 2006, pending.

(Continued)

*Primary Examiner*—Tho v Duong
(74) *Attorney, Agent, or Firm*—Nixon & Vanderhye, P.C.

(57) ABSTRACT

The heat exchanger includes a tube having axially spaced fins or a continuously spirally wound fin about the tube. One or more of the fins are dimpled, mechanically or molded, to provide concavities and projections on opposite sides of the fins or alternating concavities and projections on opposite side of the fins. The dimples improve the heat transfer between the fluid flowing through the tubes and the air circulating about the tubes and through the fins. The dimples create vortices and turbulent flow between the fins and effectively increase the heat transfer rate.

10 Claims, 2 Drawing Sheets

U.S. PATENT DOCUMENTS

| | | | | |
|---|---|---|---|---|
| 6,448,531 | B1 | 9/2002 | Esslinger et al. | |
| 6,486,438 | B1 | 11/2002 | Esslinger | |
| 6,598,781 | B2 | 7/2003 | Hasz et al. | |
| 6,644,388 | B1 | 11/2003 | Kilmer et al. | |
| 6,644,921 | B2 | 11/2003 | Bunker et al. | |
| 6,662,860 | B2 | 12/2003 | Iwamoto et al. | |
| 6,681,578 | B1 | 1/2004 | Bunker | |
| 6,722,134 | B2 | 4/2004 | Bunker | |
| 6,736,204 | B2 | 5/2004 | Gollan et al. | |
| 6,741,468 | B2 * | 5/2004 | Jing et al. | 361/700 |
| 6,761,031 | B2 | 7/2004 | Bunker | |
| 6,846,575 | B2 | 1/2005 | Hasz et al. | |
| 6,883,597 | B2 | 4/2005 | Thors et al. | |
| 6,913,074 | B2 | 7/2005 | Yamamoto et al. | |
| 6,976,301 | B2 * | 12/2005 | Sohal et al. | 29/727 |
| 7,048,043 | B2 | 5/2006 | Leterrible et al. | |
| 7,104,067 | B2 | 9/2006 | Bunker | |
| 2004/0200608 | A1 * | 10/2004 | Baldassarre | 165/181 |

OTHER PUBLICATIONS

Bunker et al., "Heat Exchanger Tube with Enhanced Heat Transfer Co-Efficient and Related Method," U.S. Appl. No. 11/541,682, filed Oct. 3, 2006.

Internet article: "Hamon Thermal Transfer"(undated).

* cited by examiner

AIR COOLED HEAT EXCHANGER WITH ENHANCED HEAT TRANSFER COEFFICIENT FINS

BACKGROUND OF THE INVENTION

The present invention relates to finned tube heat exchangers and particularly relates to air cooled heat exchangers having increased heat transfer coefficients achieved by increasing the finned surface area.

Heat exchangers having finned tubes providing heat exchange between a hot flowing fluid within the tubes and cooling air flowing about the tubes and the fins are well known. Such heat exchangers are typically manufactured by grooving the external wall of the tube and applying fin material pressed on-edge into the groove. The tube may be spirally grooved or provided with plural annular grooves for receiving the fin or fins. Alternatively, steel tubes are often coated with an aluminum jacket which is shrink fit onto the tube. Fins are extruded from the aluminum material, i.e., the aluminum material is deformed to form the fins.

It is desirable in many instances to enhance the heat transfer, i.e., increase the heat transfer coefficient, in these types of heat exchangers. However, methods to effect increased heat transfer rate or heat transfer coefficient in many products have the undesirable effect of incurring a large pressure drop penalty. Thus, airflows about the tube and fins, particularly fins having surface irregularities, pay a high cost in pressure drop to increase the heat transfer rate. Accordingly, it is desirable to provide a finned heat exchanger having enhanced thermal effectiveness with little or no added pressure loss in the fin tube bundle.

BRIEF DESCRIPTION OF A PREFERRED EMBODIMENT

In one exemplary embodiment, the invention relates to a heat exchanger comprising: at least one tube for circulating a first fluid; a plurality of fins spaced one from the other about the at least one tube, the fins being in heat exchange relation between the first fluid flowing in the tube and a second fluid flowing about the fins and tube; at least one of the fins including a pattern of dimples or at least one groove about surfaces of the at least one fin to generate fluid vortices for heat transfer enhancement with minimum pressure loss as compared with smooth, undeformed fins.

In another exemplary embodiment, the invention relates to a heat exchanger comprising at least one tube for circulating a first fluid; a single continuous fin spirally wound about the one tube and being in heat exchange relation between the fluid flowing in the tube and a second fluid flowing about the fin and the tube; the single continuous fin including a mechanically pressed pattern of dimples or at least one groove about a surface of the fin to generate fluid vortices for heat transfer enhancement with minimum pressure loss as compared with a smooth undeformed fin about the tube.

DETAILED DESCRIPTION OF THE INVENTION

Figure 1:
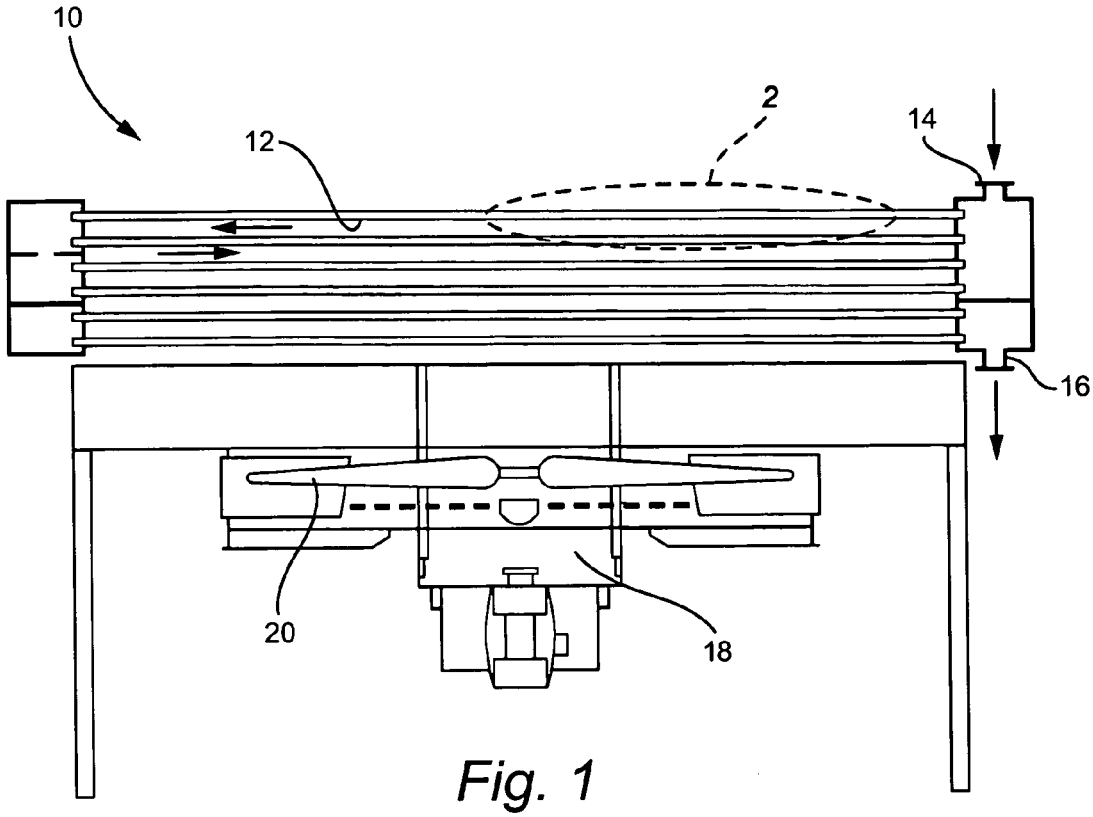
Fig. 1 (Prior Art)
FIG. 1 is a schematic illustration of a prior art heat exchanger.

Referring now to the drawings, particularly to FIG. 1, there is illustrated a conventional heat exchanger generally designated 10. Heat exchanger 10 is comprised of a plurality of interconnected tubes 12 for carrying the hot fluid which is to be cooled. The hot fluid is typically conveyed back and forth in opposite directions in tubes arranged in a large grid-like pattern. In the illustrated form, the tubes 12 extend from a hot fluid inlet 14, back and forth in the grid pattern and terminate at outlet port 16. The tubes 12 may be arranged in many different configurations, e.g., one above the other, in layers offset one above the other or in other well-known configurations. It will be appreciated that the tubes 12 lie in heat exchange relation with a cooling fluid, e.g., air, flowing about the tubes and through the grid-like pattern. It will also be appreciated that the tubes may carry a first fluid to be heated by flowing a second heated fluid about the tubes.

Figure 2:
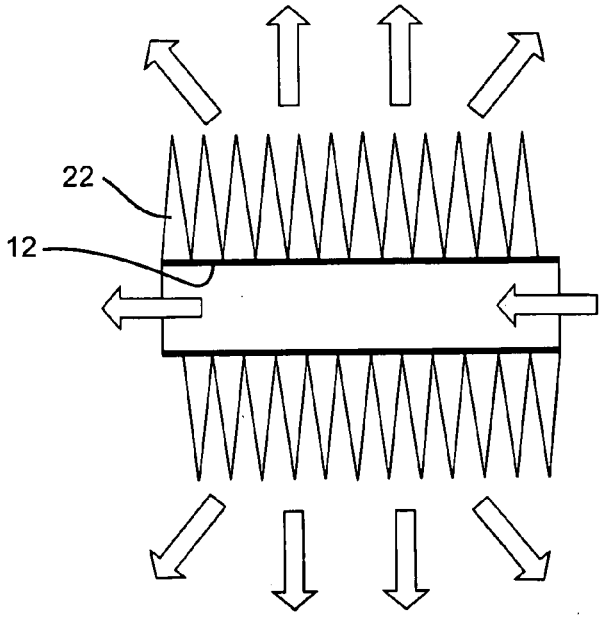
Fig. 2 (Prior Art)
FIG. 2 is a schematic illustration of a tube with fins forming part of a prior art heat exchanger.

To facilitate the heat transfer, using as an example heat exchange between tubes carrying a hot fluid and air passing about the tubes, a fan 18 with fan blades 20 is disposed, for example, below the tubes 12 for driving air through the grid of tubes 12. Thus, the air and the tubes 12 are in heat exchange relation one with the other, such that the heated fluid passing through the tubes 12 is cooled and exits the heat exchanger at 16. An enlarged schematic illustration of a finned tube 12 is illustrated in FIG. 2. Thus, the tubes in the heat exchanger may carry fins 22 which are attached to the tubes in a conventional manner for example, as described above. It will be appreciated that the fins increase the effective surface area of the interface between the cooling air and hot fluid enabling enhanced thermal cooling of the hot fluid as a result of this finned configuration.

Figure 3:
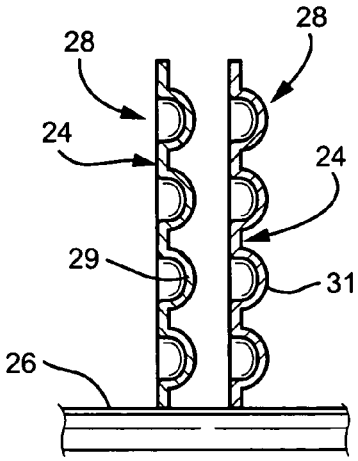
FIG. 3 is a fragmentary cross-sectional view of a heat exchanger having dimpled fins about the tube in accordance with an exemplary embodiment of the present invention.

As used in the description of exemplary embodiments of this invention, the term "fluid" embraces liquids, gases, two phase mixtures, and multi-component mixtures. Also, the heat exchanger may be of the type for condensing or evaporating the fluid. Referring to FIG. 3 there is illustrated a finned tube 26 for a heat exchanger in accordance with an exemplary embodiment of the invention. In FIG. 3, two discrete axially spaced fins 24 are illustrated although it will be appreciated that the tube carries a plurality of fins spaced from one another along the length of the tube. Each fin 24 attached to the tube 26 has a plurality of dimples 28 mechanically pressed into the fin 24, preferably from one side of the fin. Each fin 24 is preferably annular about the tube 26 although it will be appreciated that each fin 24 can be square, or have other shapes as dictated by the environment in which the finned heat exchanger may be used.

In accordance with the present invention and to increase the thermal performance of the finned tube heat exchanger hereof without significant pressure losses as compared with the pressure loss for smooth, undeformed fins, dimples 28 are provided along the surface of each fin. The dimples 28 illustrated in FIG. 3 constitute shallow projections and recesses on respective opposite sides of each fin. By providing dimples 28 on the fins 24, fluid vortices are generated for heat transfer enhancement relative to the tube 26 with little or no added pressure losses as compared with smooth, undeformed fins. From a review of FIG. 3 it will be appreciated that in this embodiment, the dimples 28 comprise generally hemispherical, recesses or concavities 29 on one side of the fin 24 and generally complementary hemispherical projections or protrusions 31 on the opposite side of the fin. The protrusions or projections 31 and the recesses 29 on respective opposite sides of the fins provide an increased number of flow surface interaction directions with the air which serve to create distributed vortices over the entire fin surface. The dimples thus enhance heat transfer coefficients and also increase wetted surface area, i.e., the surface area contacted by cooling air. Preferably, the dimples 28 are formed by a mechanical pressing operation, for example, by simple tool pressing or deformation in a continuous production facility.

Figure 4:
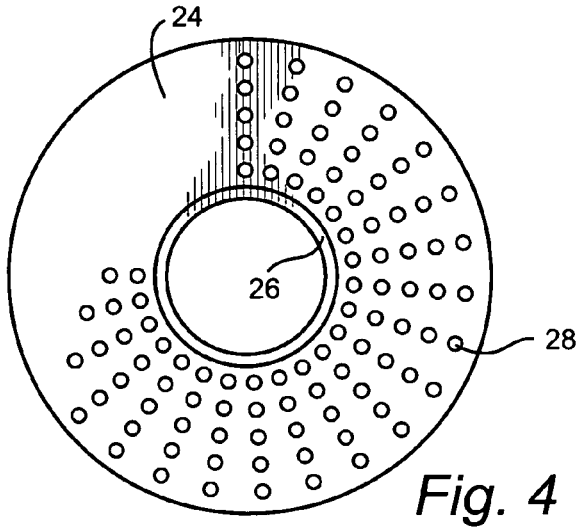
FIG. 4 is a front elevation of a finned tube of the type shown in FIG. 3, illustrating an ordered array of dimples.

In FIG. 4 there is illustrated an arrangement of dimples 28 on a fin 24 as viewed from the front of the fin. Specifically, the dimples 28 are formed along aligned radii in concentric circles about the fin. It will be appreciated however, that the dimples need not be arranged radially relative to one another or in concentric circles, and in fact the dimples can be applied randomly to the fin provided the fin surface is effectively increased for enhanced thermal transfer between the heated and cooling fluids. Also, while generally hemispherical concavities are preferred on one side of the dimpled fin with complementary hemispherical convex protrusions on the opposite side as illustrated in FIG. 3, the cavities and projections need not be exactly hemispherical. For example, the dimples can be formed with a flat bottom and beveled edges between the surface of the fin and the flat bottom. In this embodiment the airflow is diverse along the dimpled surfaces of the fins, i.e., the air flow about the dimples mixes and is turbulent to increase the heat transfer rate. The dimples also effectively increase the surface area of each fin by about 20%.

In a preferred example of the enhanced heat transfer using dimpled fins, the depth to diameter ratio of the dimples 28 may be in a range on the order of 0.1 to 0.3 and preferably about 0.2. The diameter of the dimple as it opens through the flat surface of the fin may have a dimension of about 0.10 inches. As illustrated in FIG. 3, the projection of each dimple 28 on one side of a fin 24 lies in axial registry with the cavity of a dimple of the next adjacent fin.

Figure 5:
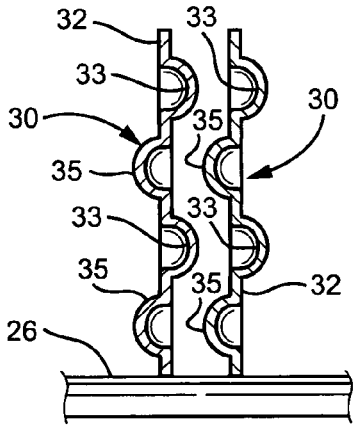
FIG. 5 is a view similar to FIG. 3 but showing an arrangement of alternating reversely-shaped dimples.

A similar arrangement is illustrated in FIG. 5 except that the dimples 30 on each fin 32 alternate in a radial direction such that a concavity 33 appears on one side of the fin 32 while the next radially adjacent dimple has a projection 35 along the opposite side of the fin. While FIG. 5 illustrates axial registration of the dimples 30 with one another between adjacent fins 32, and a radial as well as concentric alignment of the dimples as illustrated in FIG. 4, it will be appreciated that a random pattern of dimples 30 projecting to opposite sides of the fins can likewise be utilized.

Figure 6:
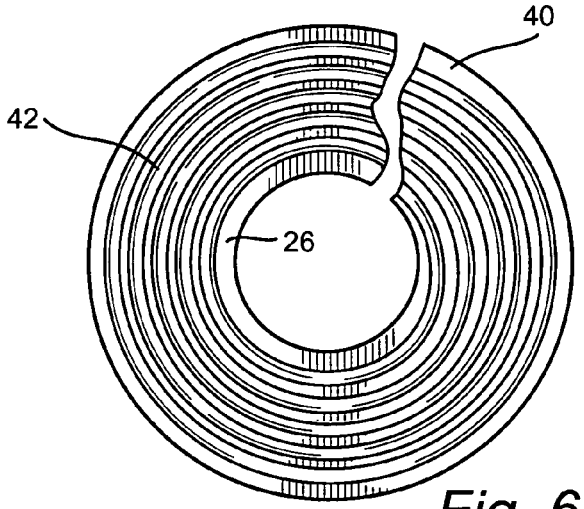
FIG. 6 is a front elevation of a tube provided with a single spiral wound fin provided with annular grooves.

Referring now to FIG. 6, there is shown a single fin 40 continuously spirally wound about a tube 26. In this case, there is provided one or more grooves 42 which likewise are continuously spirally wound with fin 40. The groove or grooves 42 are mechanically formed in fin 40 and may be pressed or molded. Preferably the grooves form projections which, on one side of the fins, lie in registration with the concave recesses formed by the grooves of an axially adjacent fin portion (similar to the registration of adjacent dimples as shown in FIGS. 3 and 5). Alternatively, a plurality of discrete fins may be disposed about the tube 26 in axial spaced locations along the tube 26. Spirally wound or concentric grooves 42 may be formed in each fin with the grooves of the fins lying in axial registration with one another. The grooves, in either case, are preferably generally semi-cylindrical in cross-section.

In a representative example, a spirally wound continuous fin for a one inch diameter tube may have a diameter of about 2.25inches and a spacing (or pitch) between adjacent fin portions of the single continuous fin 40 of about 0.10 inches.

Figure 7:
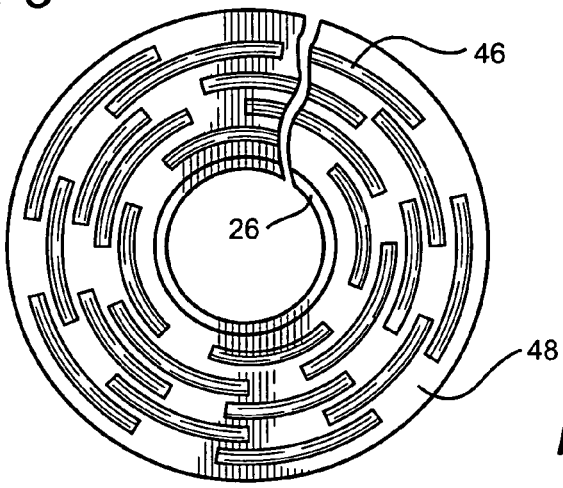
FIG. 7 is a view similar to FIG. 6 but showing segmented grooves formed on a tube fin in accordance with another exemplary embodiment of the invention.

In FIG. 7, circumferentially discontinuous grooves 46 are similarly formed in each fin 48 of a group of axially spaced fins secured to the tube 26. The fin 48 may also be a single, continuous fin spirally wound about the tube. That is, the grooves 46 are formed in arcuate segments spaced circumferentially about the fins and at generally radially spaced locations about the fin or fins. Note that the grooves 46 may be offset from each other in a radial direction.

It will be understood that the invention also embraces a combination of dimples and grooves on one or more fins, e.g., combining the groove(s) of FIGS. 6 or 7 with dimples as shown in FIGS. 3-5. It will be understood that the dimples or grooves may be provided on selected ones of said fins but not others, or may be provided on every fin within a selected region of the heat exchanger, depending on requirements.

It will be appreciated that all of the embodiments of the present invention provide increased cooling surface area to increase the thermal performance of the fins and their heat transfer coefficient. Also, with these configurations, little or no significant pressure drop occurs as air is driven past the finned tube heat exchanger as compared with fins having smooth, undeformed surfaces.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A heat exchanger comprising:

at least one tube defined by a peripheral tube wall for circulating a first fluid;

a single continuous fin spirally wound about and attached directly to said at least one tube and being in heat exchange relation between the fluid flowing in said at least one tube and a second fluid flowing about the fin and said at least one tube;

said single continuous fin having a substantially smooth, flat surface with at least one groove formed within said substantially smooth, flat surface of said single continuous fin, spaced radially outwardly of said peripheral tube wall and spaced radially inwardly an outer peripheral edge of said substantially smooth flat surface, said groove extending continuously along said single continuous fin to generate fluid vortices for heat transfer enhancement with minimum pressure loss as compared with a smooth undeformed fin wherein said at least one groove forms a projection extending outwardly of said substantially smooth flat surface on one side of said single continuous fin in a registration with a concave recess formed by said groove in an opposite side of said single continuous fin in an axially adjacent portion thereof.

2. A heat exchanger according to claim 1 wherein said single continuous fin has a diameter of about 2.25 inches.

3. A heat exchanger according to claim 2 wherein adjacent portions of said single continuous fin are spaced about 0.10 inches apart.

4. A heat exchanger according to claim 1 wherein said at least one groove is substantially semi-cylindrical in cross-section.

5. A heat exchanger according to claim 1 wherein for a tube having a 1.0 inch diameter, said single continuous fin has a diameter of about 2.25 inches and a spacing between adjacent fin portions of about 0.10 inch.

6. A heat exchanger according to claim 1 wherein said at least one groove comprises a plurality of grooves formed within said substantially smooth, flat surface of said single continuous fin wherein each of said plurality of grooves forms a projection extending outwardly of said substantially smooth flat surface on one side of said single continuous fin in registration with a concave recess formed by a respective one of said plurality grooves in an opposite side of said single continuous fin in an axially adjacent portion thereof.

7. A heat exchanger according to claim 6 wherein each of said plurality of grooves is substantially semi-cylindrical in cross-section.

8. A heat exchanger according to claim 6 wherein said single continuous fin has a diameter of about 2.25 inches.

9. A heat exchanger according to claim 6 wherein adjacent portions of said single continuous fin are spaced about 0.10 inches apart.

10. A heat exchanger according to claim 6 wherein for a tube having a 1.0 inch diameter, said single continuous fin has a diameter of about 2.25 inches and a spacing between adjacent fin portions of about 0.10 inch.

* * * * *